US009604479B2

(12) United States Patent
Kokura

(10) Patent No.: US 9,604,479 B2
(45) Date of Patent: Mar. 28, 2017

(54) IMAGE FORMING APPARATUS

(71) Applicant: Konica Minolta. Inc., Chiyoda-ku, Tokyo (JP)

(72) Inventor: Yasuhide Kokura, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/664,014

(22) Filed: Mar. 20, 2015

(65) Prior Publication Data

US 2015/0266320 A1 Sep. 24, 2015

(30) Foreign Application Priority Data

Mar. 20, 2014 (JP) ..... 2014-058591

(51) Int. Cl.
*B41J 29/38* (2006.01)
*B65H 5/00* (2006.01)
(Continued)

(52) U.S. Cl.
CPC ..... *B41J 13/0036* (2013.01); *B65H 29/125* (2013.01); *B65H 29/14* (2013.01); *B65H 39/10* (2013.01); *B65H 43/00* (2013.01); *B65H 45/14* (2013.01); *B65H 2301/4212* (2013.01); *B65H 2301/4213* (2013.01);
(Continued)

(58) Field of Classification Search
CPC ..... B41J 13/103; B41J 29/38; B41J 13/0009; B41J 11/009; B41J 13/0036; B65H 2701/1313; B65H 2701/1311; B65H 29/14; B65H 29/52
USPC ..... 347/14, 16, 104; 358/498; 271/264, 207, 271/265.01, 302
See application file for complete search history.

(56) References Cited

U.S. PATENT DOCUMENTS

2008/0303200 A1 12/2008 Ogushi et al.
2011/0286828 A1 11/2011 Iwata et al.
2012/0081487 A1* 4/2012 Tanaka et al. ..... 347/104

FOREIGN PATENT DOCUMENTS

JP H10279166 A 10/1998
JP 2003089471 A 3/2003
(Continued)

OTHER PUBLICATIONS

Japanese Notification of Reasons for Refusal corresponding to Patent Application No. 2014-058591; Mailing Date: Feb. 17, 2016, with English translation.

*Primary Examiner* — Jannelle M Lebron
(74) *Attorney, Agent, or Firm* — Cantor Colburn LLP

(57) ABSTRACT

An image forming system superposes a plurality of recording sheets on top of another by a predetermined number of sheets and discharges the recording sheets. The image forming system includes a recording sheet conveyor, a recording sheet superposition unit, and a controller. The recording sheet conveyor conveys the recording sheets. The recording sheet superposition unit superposes a preceding recording sheet and a succeeding recording sheet sent from the recording sheet conveyor. The controller controls the recording sheet superposition unit not to superpose the preceding recording sheet and the succeeding recording sheet when the controller refers to recording sheet information of the preceding recording sheet and determines that the preceding recording sheet is a recording sheet of a specified kind.

5 Claims, 16 Drawing Sheets

(51) Int. Cl.

| | |
|---|---|
| ***B41J 13/00*** | (2006.01) |
| ***B65H 29/12*** | (2006.01) |
| ***B65H 29/14*** | (2006.01) |
| ***B65H 39/10*** | (2006.01) |
| ***B65H 43/00*** | (2006.01) |
| ***B65H 45/14*** | (2006.01) |

(52) U.S. Cl.
CPC .. *B65H 2403/942* (2013.01); *B65H 2515/112* (2013.01); *B65H 2701/1123* (2013.01); *B65H 2701/125* (2013.01); *B65H 2801/27* (2013.01)

(56) References Cited

FOREIGN PATENT DOCUMENTS

| | | | |
|---|---|---|---|
| JP | 2006193320 | A | 7/2006 |
| JP | 2008303010 | A | 12/2008 |
| JP | 2009292540 | A | 12/2009 |
| JP | 2010006559 | A | 1/2010 |
| JP | 2011105503 | A | 6/2011 |
| JP | 2012001369 | A | 1/2012 |
| JP | 2013001487 | A | 1/2013 |

* cited by examiner

FIG. 13A

| Sheet No. | Specified kind | Sheaf discharge | Remarks |
|---|---|---|---|
| 1 | N/A | | |
| ··· | N/A | | |
| n | N/A | ○ | "n" recording sheets discharged |
| n+1 | Irrelevant | | 1st sheet of next group } Superposed |
| n+2 | N/A | | 2nd sheet of next group } Superposed |
| ··· | N/A | | |
| N | N/A | | Stack of recording sheets discharged |

FIG. 13B

| Sheet No. | Specified kind | Sheaf discharge | Remarks |
|---|---|---|---|
| 1 | N/A | | |
| ··· | N/A | | |
| n min(m) | N/A | ○ | Minimum sheafing discharge number of sheets<br>Stack of n1 (nmin) recording sheets sheafed and discharged |
| n1+1 | Irrelevant | | 1st sheet of next group } Superposed |
| n1+2 | N/A | | 2nd sheet of next group } Superposed |
| ··· | N/A | | |
| n+1 | Relevant | | |
| ··· | N/A | | |
| N | N/A | | Stack of recording sheets discharged |

FIG. 13C

| Sheet No. | Specified kind | Sheaf discharge | Remarks |
|---|---|---|---|
| 1 | N/A | | |
| ··· | N/A | | |
| n min(m) | N/A | | Minimum sheafing discharge number of sheets |
| ··· | Relevant | | Stack of n1 recording sheets not sheafed and discharged |
| n+1 | Relevant | | |
| ··· | Relevant | | |
| n max(l) | Relevant | ○ | Maximum sheafing discharge number of sheets<br>Stack of n2 (nmax) recording sheets sheafed and discharged |
| n2+1 | Irrelevant | | 1st sheet of next group } Superposed |
| n2+2 | N/A | | 2nd sheet of next group } Superposed |
| ··· | N/A | | |
| N | N/A | | Stack of recording sheets discharged |

FIG. 13D

| Sheet No. | Specified kind | Sheaf discharge | Remarks |
|---|---|---|---|
| 1 | N/A | | |
| ··· | N/A | | |
| n min(m) | N/A | | Minimum sheafing discharge number of sheets |
| ··· | Relevant | | Stack of n1 recording sheets not sheafed and discharged |
| n+1 | Relevant | | |
| ··· | Relevant | | |
| n max(l) | Relevant | ○ | Maximum sheafing discharge number of sheets<br>Stack of n2 (nmax) recording sheets sheafed and discharged |
| n2+1 | Relevant | | Not superposed |
| n2+2 | N/A | | |
| ··· | N/A | | |
| N | N/A | | Stack of recording sheets discharged |

IMAGE FORMING APPARATUS

CROSS-REFERENCE TO RELATED APPLICATIONS

The present application claims priority under 35 U.S.C. §119 to Japanese Patent Application No. 2014-058591, filed Mar. 20, 2014. The contents of this application are incorporated herein by reference in their entirety.

BACKGROUND OF THE INVENTION

Field of the Invention

The present invention relates to an image forming system.

Discussion of the Background

When a large amount of recording sheets are discharged from an image forming apparatus, the recording sheets become bulky and unstably discharged. Consequently, alignment of the recording sheets stacked on a discharge tray is degraded significantly, which has conventionally resulted in problems. For example, sorted portions of the recording sheets may be difficult to recognize. A jam may be caused at the time of discharging the recording sheets. The recording sheets may fall off the discharge tray. In order to stabilize alignment of a stack of recording sheets, there has been proposed an image forming apparatus to sheaf recording sheets by a predetermined number of sheets and discharge a sheaf of the recording sheets. Similarly, there has been proposed a post-processor attached to an image forming apparatus to accommodate recording sheets in a stack tray of the post-processor before a stack of the recording sheets are discharged to the discharge tray. From the stack tray, the recording sheets are sheafed by a predetermined number of sheets and discharged. A decrease in productivity of such a post-processor due to sheafing discharge should be prevented even in the case of sheafing discharge of the recording sheets. For this purpose, the post-processor executes the following control. A succeeding recording sheet is conveyed at the same recording sheet conveyance interval as normal conveyance, and conveyance of a preceding recording sheet is stopped, or the preceding recording sheet is sidetracked to a separate sidetracking path. At a conveyance timing of the succeeding recording sheet, the preceding recording sheet and the succeeding recording sheet are superposed and discharged.

In the above-described control method, there is a case in which the preceding recording sheet on which the succeeding recording sheet is superposed is a recording sheet of a specified kind unsuitable to superposition. Examples of the recording sheet of the specified kind include a thick sheet, a folded recording sheet, or a recording sheet having a surface subjected to particular processing. When a recording sheet of such a specified kind is the preceding recording sheet, problems occur at the time of switching back the preceding recording sheet prior to sidetracking or at the time of superposition of the succeeding recording sheet on the preceding recording sheet. For example, separation and slip of conveyance rollers may unfortunately cause misalignment of folded portions, multiple folding, damage to the recording sheet, and defective conveyance.

In order to solve the above-described problems, as disclosed in Japanese Patent No. 5036632 and Japanese Unexamined Patent Application Publication No. 2011-105503, a post-processor includes a first conveyance path and a second conveyance path. The first conveyance path conveys recording sheets of a non-specified kind. A pre-stack portion is disposed on the first conveyance path. The second conveyance path conveys recording sheets of a specified kind and communicates with the first conveyance path on the downstream side of the pre-stack portion. The recording sheets are superposed and conveyed on the downstream side of these conveyance paths.

However, in such a configuration as disclosed in Japanese Patent No. 5036632 and Japanese Unexamined Patent Application Publication No. 2011-105503, the conveyance path to convey recording sheets of the specified kind is required for exclusive use. Consequently, it is necessary to provide a plurality of conveyance paths. This enlarges the apparatus and increases the number of component parts, which causes an increase in the cost.

The present invention has been made to solve the above-described problems. It is a technical object of the present invention to provide an image forming system that prevents enlargement of the apparatus and an increase in the number of component parts. Even in the case of a printing job including recording sheets of a specified kind, the image forming system stabilizes alignment of the recording sheets when discharged.

SUMMARY OF THE INVENTION

According to one aspect of the present invention, an image forming system is configured to superpose a plurality of recording sheets on top of another by a predetermined number of sheets and discharge the recording sheets. The image forming system includes a recording sheet conveyor, a recording sheet superposition unit, and a controller. The recording sheet conveyor is configured to convey the recording sheets. The recording sheet superposition unit is configured to superpose a preceding recording sheet and a succeeding recording sheet sent from the recording sheet conveyor. The controller is configured to control the recording sheet superposition unit not to superpose the preceding recording sheet and the succeeding recording sheet when the controller refers to recording sheet information of the preceding recording sheet and determines that the preceding recording sheet is a recording sheet of a specified kind.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIGS. 13A to 13D are tables illustrating exemplary control of the number of a stack of recording sheets in the post-processor.

DESCRIPTION OF THE EMBODIMENTS

Figure 1:
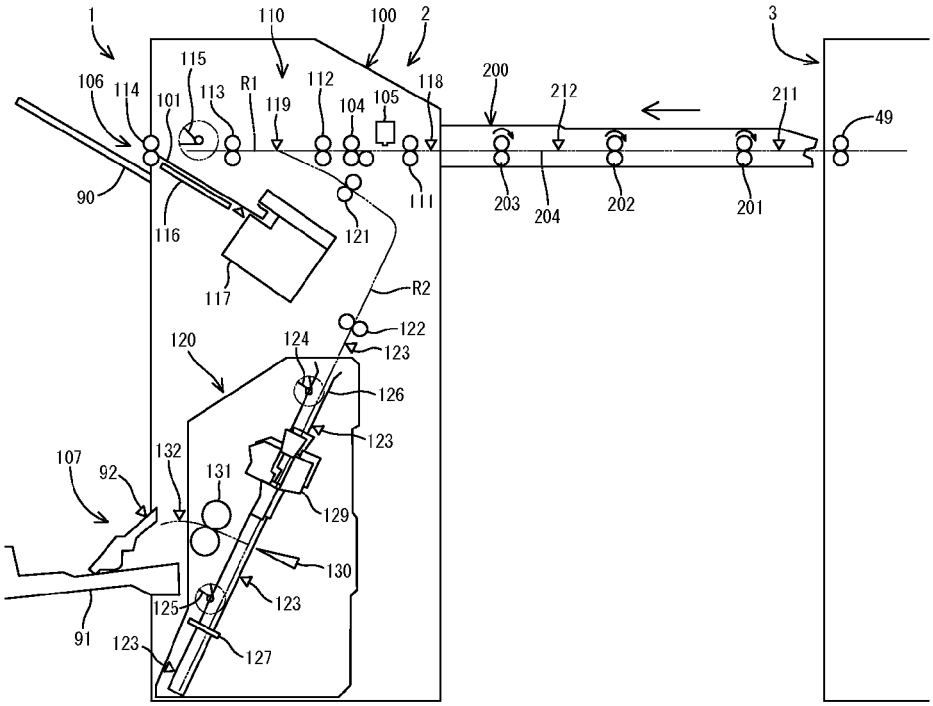
FIG. 1 is a schematic diagram illustrating a configuration of a post-processor according to a first embodiment.

The embodiments will now be described with reference to the accompanying drawings, wherein like reference numerals designate corresponding or identical elements throughout the various drawings.

(1) Outline of Image Forming System

Figure 2:
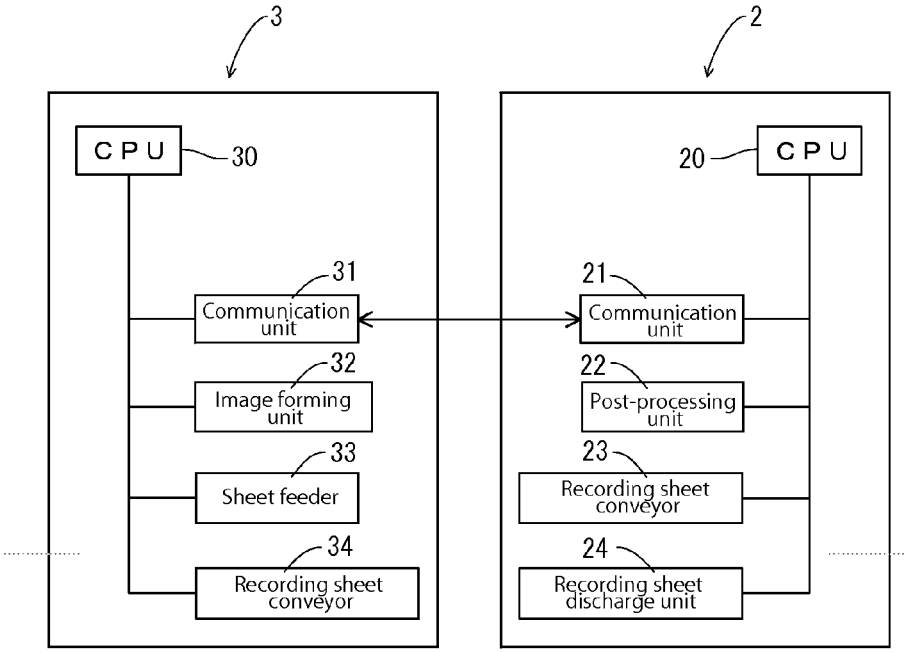
FIG. 2 is a block diagram illustrating a configuration of a controller.

First, a configuration of an image forming system 1 according to an embodiment will be described. The image forming system 1 mainly includes an image forming apparatus 3 and a post-processor 2 attached to the image forming apparatus 3. Referring to FIGS. 1 and 2, the post-processor 2 and the image forming apparatus 3 will be described below.

The image forming apparatus 3 is an apparatus such as a copying machine, a printer, and a multifunctional peripheral, and forms images on recording sheets P. More specifically, the image forming apparatus 3 includes an automatic document feeder (ADF), a scanner, a print engine, and a sheet feed unit. The ADF executes automatic continuous conveyance of documents in copying operation and scanning operation. The scanner reads each document and generates image data. Based on the image data generated by the scanner or image data stored in advance, the print engine forms an image on a recording sheet P. The sheet feed unit feeds the recording sheet P on which the image is formed by the print engine. The image forming apparatus 3 transmits and receives data through a network (communication network) such as LAN and telephone lines. Image data is input from another computer to the image forming apparatus 3 through the network. Based on the image data, the image forming apparatus executes printing.

As shown in FIG. 2, the image forming apparatus 3 includes a CPU 30, a communication unit 31, an image forming unit 32, a sheet feeder 33, and a recording sheet conveyor 34. The communication unit 31 transmits, to the post-processor 2, recording sheet information required for post-processing, for example, the number of sheets of a printing job, a size of recording sheets, a kind of recording sheet media (such as a basis weight of recording sheets P), and post-processing setting. The communication unit 31 receives required information such as post-processing states from the post-processor 2. The CPU 30 functions as a controller to control image formation, sheet feed, and recording sheet conveyance in accordance with information acquired from the components. The image forming unit 32 executes image formation in response to a command from the CPU 30. The sheet feeder 33 feeds predetermined recording sheets P to the image forming unit 32 in response to a command from the CPU 30. The recording sheet conveyor 34 conveys, to the post-processor 2, the recording sheets P on which images have been formed by the image forming unit 32.

The post-processor 2 is attached to the image forming apparatus 3. After images are formed on recording sheets P in the image forming apparatus 3, the post-processor 2 subjects the recording sheets P to post-processing such as stapling (binding), punching (perforating), stamping, and sorting. For example, the post-processor 2 successively accommodates recording sheets P sent from the image forming apparatus 3 in a stack portion 101. The post-processor 2 subjects, to set post-processing, a stack of recording sheets, which is a pile of recording sheets P accommodated by a predetermined number of sheets at one time. Then, the post-processor 2 discharges the stack of recording sheets.

The post-processor 2 includes a CPU 20, a communication unit 21, a post-processing unit 22, a recording sheet conveyor 23, and a recording sheet discharge unit 24. The communication unit 21 transmits required information such as post-processing states to the communication unit 31 of the image forming apparatus 3. Also, the communication unit 21 receives the above-described recording sheet information from the communication unit 31. The CPU 20 functions as a controller to control at the time of post-processing based on the recording sheet information received by the communication unit 21. In response to a command from the CPU 20, the post-processing unit 22 executes predetermined post-processing. The recording sheet conveyor 23 conveys recording sheets P sent from the image forming apparatus 3. The recording sheet discharge unit 24 discharges a stack of recording sheets after the post-processing.

<First Embodiment>

(2) Configuration and Outlined Operation of Post-Processor

Description will now be made on the post-processor 2 according to an embodiment.

First, a configuration of the post-processor 2 will be described. As shown in FIG. 1, the post-processor 2 includes a post-processing unit 100 and a horizontal conveyor 200. The horizontal conveyor 200 conveys recording sheets P sent from the image forming apparatus 3 to the subsequent post-processing unit 100. The post-processing unit 100 subjects the recording sheets P conveyed by the horizontal conveyor 200 to post-processing such as stapling (binding), punching (perforating), stamping, sorting, and folding.

The horizontal conveyor 200 includes a horizontal conveyance path 204, first horizontal conveyance rollers 201, second horizontal conveyance rollers 202, third horizontal conveyance rollers 203, an entry sensor 211, and an intermediate sensor 212. The first horizontal conveyance rollers 201, the second horizontal conveyance rollers 202, and the third horizontal conveyance rollers 203 convey each recording sheet P along the horizontal conveyance path 204, and are disposed in sequence from the upstream side. The entry sensor 211 and the intermediate sensor 212 detect the presence of the recording sheet P, and are disposed in sequence from the upstream side.

When discharge rollers 49 of the image forming apparatus 3 start sending a recording sheet P, the first horizontal conveyance rollers 201, the second horizontal conveyance rollers 202, and the third horizontal conveyance rollers 203 start rotating in sequence. These horizontal conveyance rollers rotate in the directions indicated by the arrows in FIG. 1. Thus, the recording sheet P sent by the discharge rollers 49 of the image forming apparatus 3 is conveyed to the post-processing unit 100 at a predetermined conveyance speed. A state of conveyance of the recording sheet P is detected by the entry sensor 211 disposed on a side of the discharge rollers 49 of the image forming apparatus 3 and by the intermediate sensor 212 disposed on a side of the post-processing unit 100.

The post-processing unit 100 includes a side stitcher 110, a saddle stitcher 120, a main tray 90, and a booklet tray 91. Also, the post-processing unit 100 includes a first conveyance path R1, a second conveyance path R2, a first discharge slot 106, and a second discharge slot 107. Along the first conveyance path R1, a recording sheet P conveyed by the horizontal conveyor 200 is conveyed to the stack tray 101 of the side stitcher 110. Along the second conveyance path R2 diverging from the first conveyance path R1, the recording sheet P is conveyed to a saddle stitching tray 126 of the saddle stitcher 120. The recording sheet P subjected to post-processing at the side stitcher 110 is discharged through the first discharge slot 106. The recording sheet P subjected to post-processing at the saddle stitcher 120 is discharged from the second discharge slot 107.

The side stitcher 110 performs side stitching or sorting. Specifically, the side stitcher 110 includes resistance rollers 111, intermediate rollers 112, accommodation rollers 113, main tray discharge rollers 114, the stack tray 101, an accommodation paddle 115, an accommodation belt 116, a side stitch stapler 117, a resistance sensor 118, and an accommodation sensor 119. The resistance rollers 111, the intermediate rollers 112, the accommodation rollers 113, and the main tray discharge rollers 114 are disposed along the first conveyance path R1 in sequence from the upstream side so as to convey the recording sheet P. The stack tray 101 is disposed between the accommodation rollers 113 and the main tray discharge rollers 114 and temporarily accommodates the recording sheet P. The accommodation paddle 115 and the accommodation belt 116 are disposed between the accommodation rollers 113 and the main tray discharge rollers 114 and guide the recording sheet P to the stack tray 101. The side stitch stapler 117 performs side stitching of the recording sheet P accommodated in the stack tray 101. The resistance sensor 118 and the accommodation sensor 119 detect the presence and a conveyance state of the recording sheet P and are disposed in sequence from the upstream side.

The side stitcher 110 further includes Z-folding rollers 104 and a puncher 105. The Z-folding rollers 104 and the puncher 105 are disposed on the upstream side of a diverging point of the first conveyance path R1 from which the second conveyance path R2 diverges. The Z-folding rollers 104 Z-fold the recording sheet P. The puncher 105 punches a hole in the recording sheet P.

The saddle stitcher 120 executes saddle stitching or folding into halves. Specifically, the saddle stitcher 120 includes switch-back rollers 121, saddle-stitch entry rollers 122, the saddle stitching tray 126, a saddle-stitch entry sensor 123, an upper saddle-stitch paddle 124, a lower saddle-stitch paddle 125, a stopper 127, a clamping member (not shown), a saddle stitch stapler 129, a folding knife 130, folding rollers 131, and a folding discharge sensor 132. The switch-back rollers 121 and the saddle-stitch entry rollers 122 are disposed along the second conveyance path R2 in sequence from the upstream side so as to convey the recording sheet P. The saddle stitching tray 126 temporarily accommodates the recording sheet P. The saddle-stitch entry sensor 123 detects the presence of the recording sheet P and whether the recording sheet P reaches the saddle stitching tray 126 on the second conveyance path R2. The upper saddle-stitch paddle 124 is disposed above the saddle stitching tray 126 and guides the recording sheet P. The lower saddle-stitch paddle 125 is disposed below the saddle stitching tray 126 and guides the recording sheet P. The stopper 127 is disposed on the saddle stitching tray 126 movably along the second conveyance path R2 and restricts the position of a lower end of the recording sheet P. The clamping member is attached to the stopper 127 and clamps the lower end of the recording sheet P. The saddle stitch stapler 129 is disposed between the upper saddle-stitch paddle 124 and the lower saddle-stitch paddle 125 and performs saddle stitching of the recording sheet P. The folding knife 130 is disposed between the saddle stitch stapler 129 and the lower saddle-stitch paddle 125 and has an edge facing the second discharge slot 107. The folding rollers 131 has a nip portion at a position corresponding to the edge of the folding knife 130. While folding the recording sheet P, the folding rollers 131 guide the recording sheet P toward the second discharge slot 107. The folding discharge sensor 132 is disposed adjacent to the second discharge slot 107 and detects whether the recording sheet P, which has been subjected to post-processing, is discharged.

The above-described rollers are changeable to normally rotate, reversely rotate, and stop (idle). These rollers constitute the recording sheet conveyor 23 and the recording sheet discharge unit 24. At least the accommodation rollers 113 and the main tray discharge rollers 114 are changeable between a pressurized contact state and a separate state.

Recording sheets P, which have been subjected to post-processing by the side stitcher 110, are stacked on the main tray 90. Recording sheets P, which have been subjected to post-processing by the saddle stitcher 120, are stacked on the booklet tray 91. A booklet-tray presence detection sensor 92 is disposed above the booklet tray 91 and detects the presence of the recording sheets P stacked on the booklet tray 91.

Figure 3:
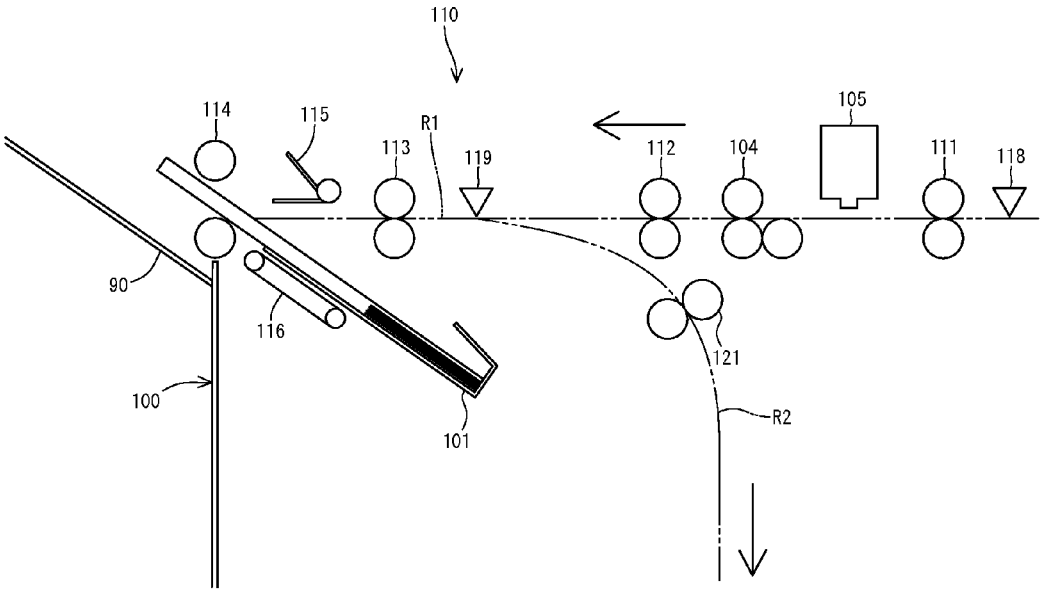
FIG. 3 is a schematic diagram illustrating the post-processor.

Next, an outline of operation of the post-processor 2 will be described. As shown in FIGS. 1 and 3, a recording sheet P, which has been sent by the horizontal conveyor 200, is subjected to side stitching or sorting. In this case, along the first conveyance path R1, the recording sheet P is conveyed to the side stitcher 110 through the resistance rollers 111, the intermediate rollers 112, and the accommodation rollers 113. When a recording sheet P is subjected to saddle stitching or folding into halves, the recording sheet P is conveyed to the side stitcher 110 along the first conveyance path R1 once. Then, the recording sheet P is switched back and conveyed to the saddle stitcher 120 along the second conveyance path R2 diverging from the first conveyance path R1. Such a conveyance state of the recording sheet P is detected by the resistance sensor 118 on the horizontal conveyor 200 side (upstream side) and by the accommodation sensor 119 at an intermediate position of the first conveyance path R1.

Figure 4A:
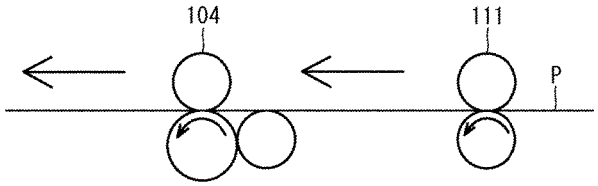
FIGS. 4A to 4E are diagrams illustrating Z-folding steps of the post-processor.
Figure 4B:
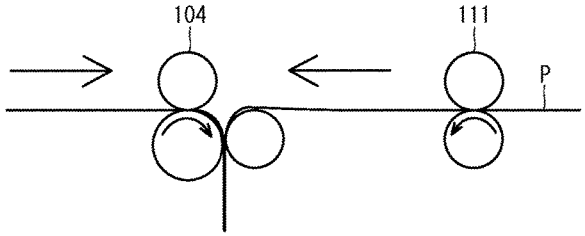
Figure 4C:
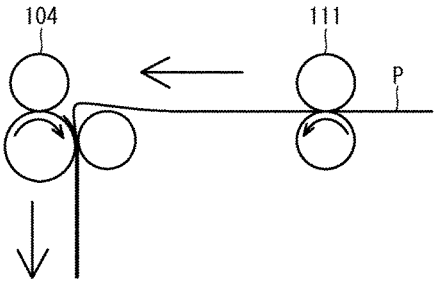
Figure 4D:
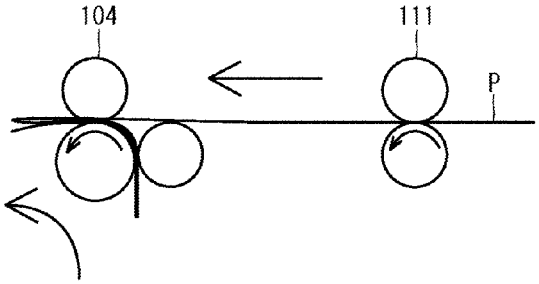
Figure 4E:
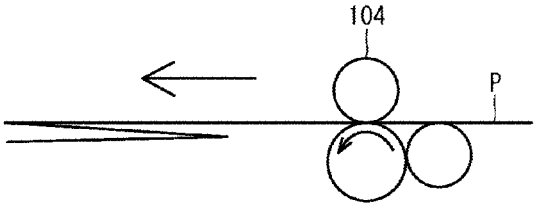

Description will now be made on an outline of Z-folding operation of a recording sheet P by the Z-folding rollers 104 at an intermediate position of the first conveyance path R1. As shown in FIG. 4A, the Z-folding rollers 104 along with the resistance rollers 111 first rotate normally to convey the recording sheet P from the upstream side to the downstream side (in a normal direction). Next, a leading edge of the recording sheet P for Z-folding reaches a predetermined position. Then, as shown in FIG. 4B, the Z-folding rollers 104 rotate reversely to draw a loop of the recording sheet P in a direction perpendicular to the first conveyance path R1 (downwardly). After the Z-folding rollers 104 draw the loop of the recording sheet P downwardly, as shown in FIG. 4C, the Z-folding rollers 104 are stopped (idled) to make another loop of the recording sheet P. After this loop is formed to have a predetermined length, as shown in FIG. 4D, the Z-folding rollers 104 normally rotate to superpose the loop on the leading edge of the recording sheet P and draw the loop and the leading edge of the recording sheet P in the normal direction along the first conveyance path R1. Thus, as shown in FIG. 4E, Z-folding of the recording sheet P is ended.

Next, side stitching will be described. When a recording sheet P is conveyed to the side stitcher 110, the resistance rollers 111, the intermediate rollers 112, and the accommodation rollers 113 are driven to convey the recording sheet P to the stack tray 101 as the stack portion along the first conveyance path R1.

Figure 5:
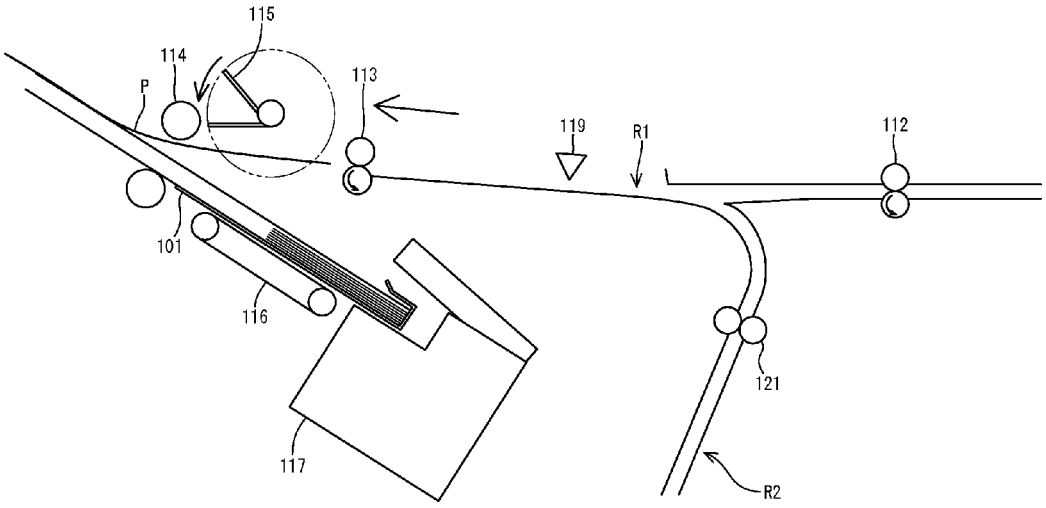
FIG. 5 is a diagram illustrating a post-processing step of the post-processor.

When post-processing (side stitching or sorting) is performed in the side stitcher 110, the main tray discharge rollers 114 are separated from each other, as shown in FIG. 5. After a trailing edge of the conveyed recording sheet P passes the accommodation rollers 113, the accommodation paddle 115 is driven to accommodate the recording sheet P in the stack tray 101. After the recording sheet P is accommodated in the stack tray 101, the accommodation paddle 115 is operated continuously to execute alignment of the recording sheet P in a longitudinal direction (recording sheet conveyance direction). When the longitudinal alignment of the recording sheet P in the stack tray 101 is ended, widthwise alignment of a stack of recording sheets is executed by side-stitch alignment plates (not shown). After the longitudinal and widthwise alignment of the recording sheets P is ended, side stitches are applied to a predetermined position of the stack of recording sheets by the side stitch stapler 117.

The side stitch stapler 117 is arranged to be movable in the recording sheet widthwise direction. The side stitch stapler 117 is controlled to move to an appropriate position in a widthwise direction of the stack of recording sheets in accordance with side stitch setting selected from one-point stitching and two-point stitching.

In the case of sorting, after the longitudinal alignment of the last recording sheet P of the stack of recording sheets, the stack of recording sheets are offset (shifted) to one side or the other side in the widthwise direction of the recording sheet P by the side-stitch alignment plates.

Post-processing of the stack of recording sheets is performed by the side stitcher 110 in the above-described manner. Subsequently, the main tray discharge rollers 114 are pressed against each other and driven to discharge the stack of recording sheets to the main tray 90 through the first discharge slot 106.

Saddle stitching will now be described. In this case, a recording sheet P is conveyed to the side stitcher 110 once. Then, the recording sheet P is switched back and conveyed to the saddle stitcher 120 along the second conveyance path R2 diverging from the first conveyance path R1. A connection point between the first conveyance path R1 and the second conveyance path R2 is located between the intermediate rollers 112 and the accommodation rollers 113. In this embodiment, the accommodation sensor 119 is disposed at this connection point. At the time of switching back, immediately after a trailing edge of the recording sheet P passes the accommodation sensor 119, the accommodation rollers 113 are stopped. Then, the accommodation rollers 113 are driven reversely, and also, the switch-back rollers 121 and the saddle-stitch entry rollers 122 disposed on the second conveyance path R2 are driven. Thus, the recording sheet P is conveyed to the saddle stitching tray 126.

When a predetermined period of time elapses after a leading edge of the recording sheet P reaches the saddle-stitch entry sensor 123, the upper saddle-stitch paddle 124 and the lower saddle-stitch paddle 125 are driven to accommodate the recording sheet P in the saddle stitching tray 126. The recording sheet P accommodated in the saddle stitching tray 126 is held at a predetermined position by the stopper 127. The stopper 127 is controlled to be in such a position that when the recording sheet P is accommodated in the saddle stitching tray 126, the trailing edge of the recording sheet P is constantly located on the downstream side of the saddle-stitch entry sensor 123 irrespective of the length of the recording sheet P. Saddle-stitch alignment plates are disposed on both ends of the saddle stitching tray 126 in the widthwise direction of the recording sheet P. The saddle-stitch alignment plates are operated to execute widthwise alignment of the recording sheet P. Thus, alignment of the final position of the stack of recording sheets is performed.

After the end of the final position alignment of the stack of recording sheets, a lower end portion of the stack of recording sheets is clamped by the clamping member (not shown) attached to the stopper 127. Then, the stopper 127 moves downwardly to displace the stack of recording sheets to a saddle stitching position. In order to displace the stack of recording sheets to the saddle stitching position, an amount of downward movement of the stopper 127 is controlled in accordance with the length (length in the conveyance direction) of the stack of recording sheets. When the displacement of the stack of recording sheets to the saddle stitching position is ended, saddle stitches are applied to the stack of recording sheets by the saddle stitch stapler 129.

After saddle stitching, the stopper 127 moves downwardly to displace the stack of recording sheets to a folding discharge position. In the displacement of the stack of recording sheets to the folding discharge position, an amount of downward movement of the stopper 127 is kept constant irrespective of the length (length in the conveyance direction) of the stack of recording sheets. When the displacement to the folding discharge position is ended, the lower end portion of the stack of recording sheets is unclamped. While the stack of recording sheets is being folded by the folding knife 130 moving to the folding discharge slot, the stack of recording sheets is brought into contact with a nip portion between the folding rollers 131 being driven. Then, the stack of recording sheets is folded by the folding rollers 131 and discharged to the booklet tray 91 through the second discharge slot 107.

(3) Recording Sheet Sheafing Discharge and Superposition Conveyance

Next, referring to FIGS. 5 to 12, description will be made on sheafing discharge of a stack of recording sheets and superposition of recording sheets P by a recording sheet superposition unit according to an embodiment.

First, as shown in FIG. 5, after a last recording sheet P of a preceding stack of recording sheets passes the accommodation rollers 113, the accommodation paddle 115 is rotated a predetermined number of times, and the recording sheet P is accommodated in the stack tray 101. Then, the above-described alignment of the stack of recording sheets in the longitudinal direction and the widthwise direction is performed. When the alignment is ended, the side-stitch alignment plates are stopped, and post-processing (stapling or sorting) of the stack of recording sheets is started. The number of recording sheets P to be printed is a predetermined number N transmitted from the image forming apparatus 3. It should be noted that the main tray discharge rollers 114 are separated from each other.

Figure 6:
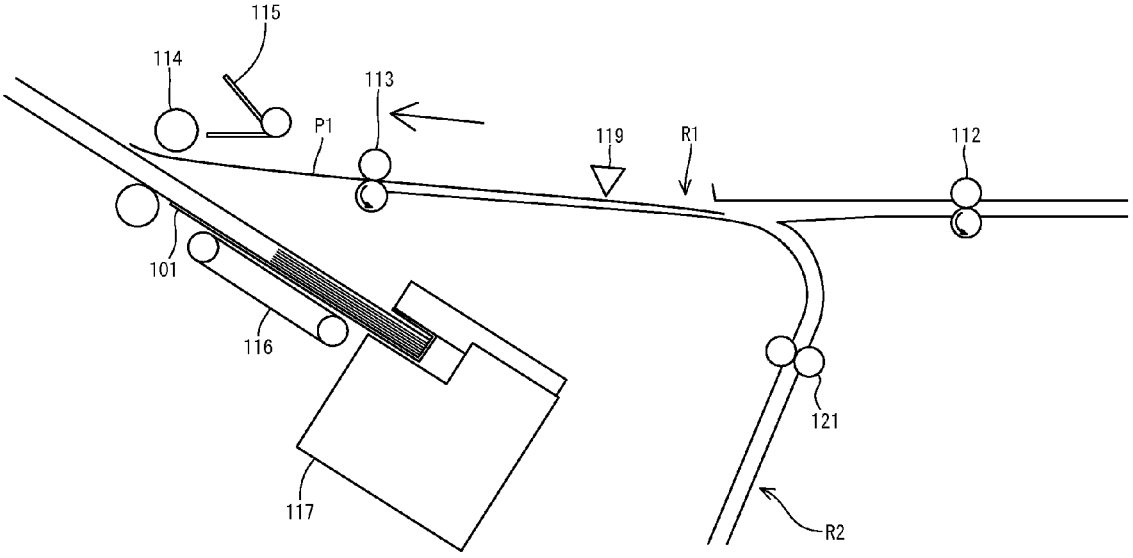
FIG. 6 is a diagram illustrating a post-processing step of the post-processor.

Next, a first recording sheet P1 (preceding recording sheet) of a subsequent group following the preceding stack of recording sheets is sent from the horizontal conveyor 200 at the same interval as normal conveyance. As shown in FIG. 6, through the first conveyance path R1, a trailing edge of the first recording sheet P1 of the subsequent group is conveyed to the downstream side of the diverging point between the first conveyance path R1 and the second conveyance path R2, specifically, to the downstream side of the accommodation sensor 119, by the rollers of the side stitcher 110. At this time, the preceding stack of recording sheets are in course of post-processing (side stitching in this embodiment).

Figure 7:
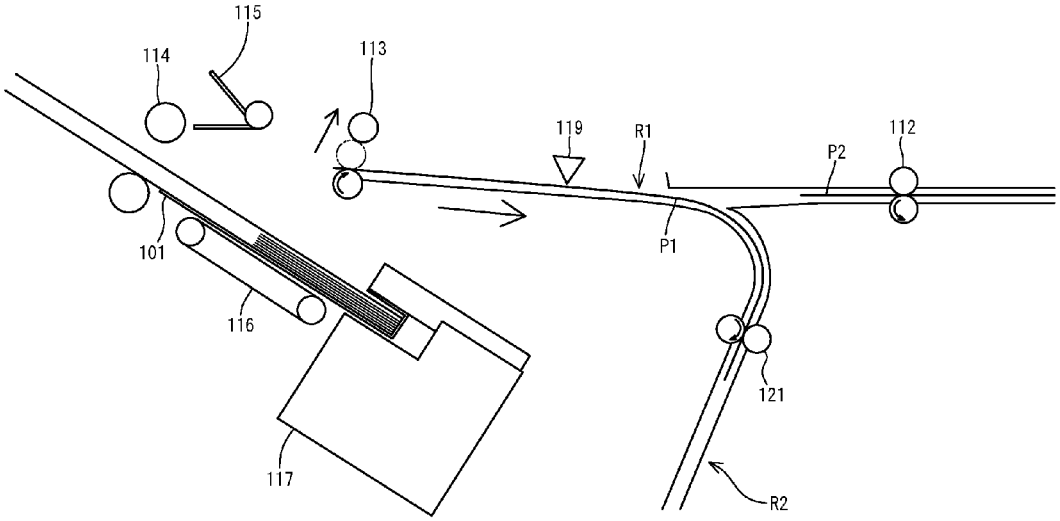
FIG. 7 is a diagram illustrating a post-processing step of the post-processor.

When the trailing edge of the first recording sheet P1 of the subsequent group passes the accommodation sensor 119, the accommodation rollers 113 are stopped to stop conveyance of the first recording sheet P1 of the subsequent group. When a predetermined period of time elapses after the conveyance stop of the first recording sheet P1 of the subsequent group, the accommodation rollers 113 are rotated reversely, and also, the switch-back rollers 121 are rotated normally (rotated toward the downstream side of the second conveyance path R2), as shown in FIG. 7. Thus, the first recording sheet P1 of the subsequent group is switched back and sidetracked to the second conveyance path R2. While being sidetracked to the second conveyance path R2, the first recording sheet P1 of the subsequent group passes the switch-back rollers 121. Then, the accommodation rollers 113 are separated and stopped. When the trailing edge (edge on the downstream side of the second conveyance path R2) of the first recording sheet P1 of the subsequent group reaches a sidetrack end position, the switch-back rollers 121 are stopped to hold the first recording sheet P1 of the subsequent group at the sidetrack end position. In the post-processing unit 100 of this embodiment, a position and a recording sheet conveyance amount of the accommodation rollers 113 and a recording sheet conveyance amount of the switch-back rollers 121 are set in such a manner that part of the first recording sheet P1 of the subsequent group at the sidetrack end position remains on the first conveyance path R1.

Figure 8:
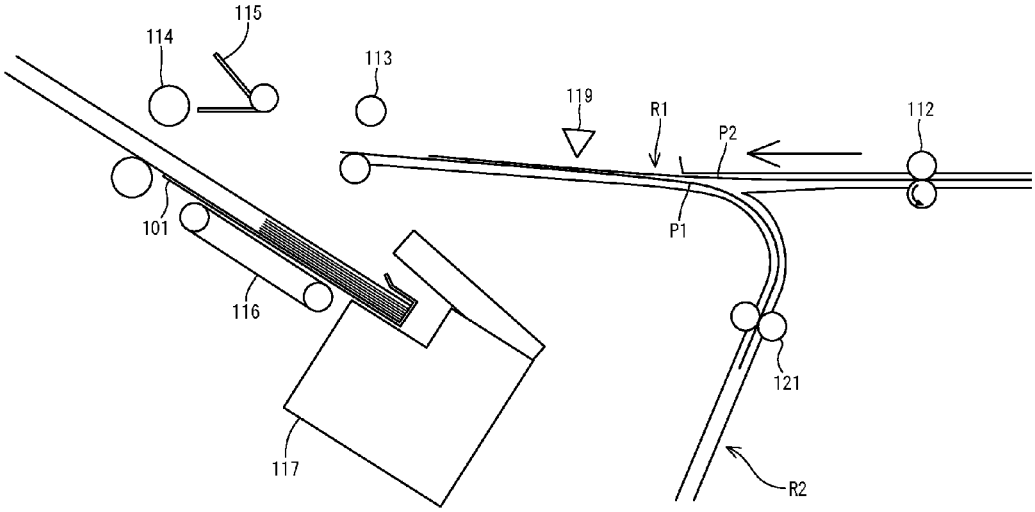
FIG. 8 is a diagram illustrating a post-processing step of the post-processor.

Next, following the first recording sheet P1 of the subsequent group, a second recording sheet P2 (succeeding recording sheet) of the subsequent group is conveyed from the horizontal conveyor 200 at the same conveyance interval as normal conveyance. As shown in FIG. 8, the second recording sheet P2 of the subsequent group is conveyed through the first conveyance path R1 in the same manner as the first recording sheet P1 of the subsequent group. When conveyed, the second recording sheet P2 of the subsequent group is superposed on the part of the first recording sheet P1 of the subsequent group that remains on the first conveyance path R1.

Figure 9:
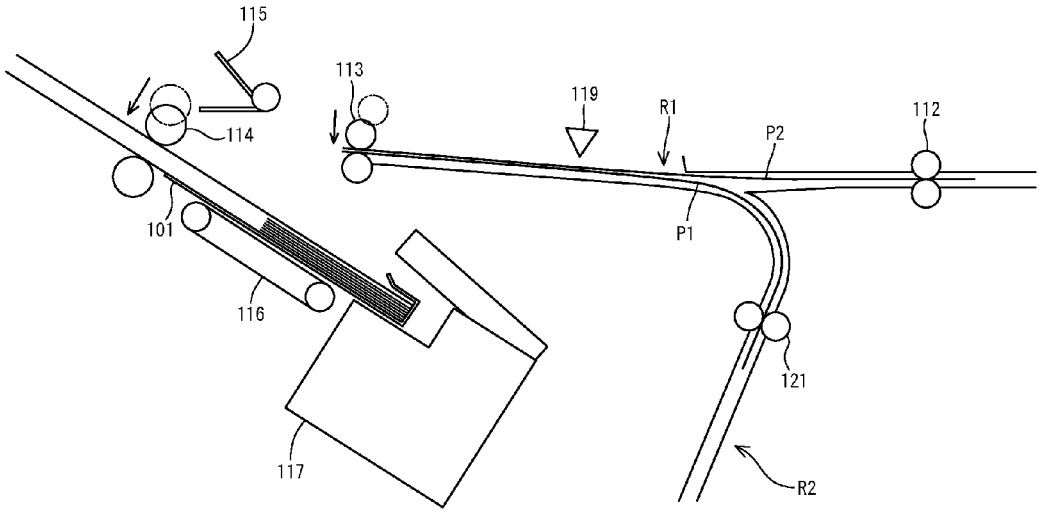
FIG. 9 is a diagram illustrating a post-processing step of the post-processor.

When a trailing edge of the second recording sheet P2 of the subsequent group reaches a superposition conveyance position, the intermediate rollers 112 are stopped to stop the conveyance of the second recording sheet P2 of the subsequent group, as shown in FIG. 9. In this embodiment, the superposition conveyance position is set to be the same as a stop position for punching. Also, the sidetrack end position of the first recording sheet P1 of the subsequent group and the superposition conveyance position of the second recording sheet P2 of the subsequent group are set to have an equal distance to the nip portion of the accommodation rollers 113.

Figure 10:
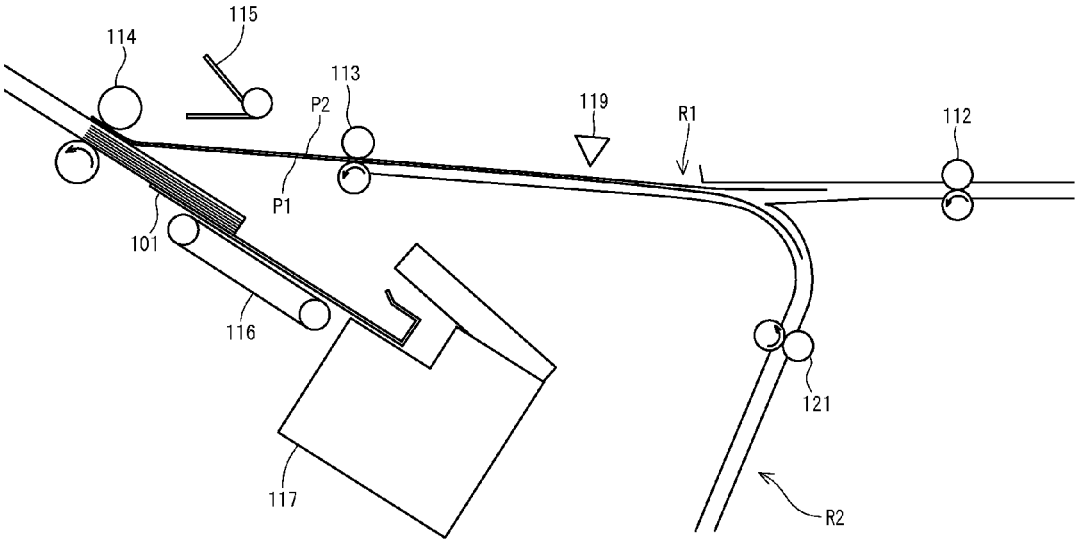
FIG. 10 is a diagram illustrating a post-processing step of the post-processor.

When a predetermined period of time elapses after the conveyance stop of the second recording sheet P2 of the subsequent group, the accommodation rollers 113 and the main tray discharge rollers 114 are respectively changed to the pressurized contact states. After this change, as shown in FIG. 10, the intermediate rollers 112, the accommodation rollers 113, and the main tray discharge rollers 114 are rotated normally. At the same time, the switch-back rollers 121 are rotated reversely (rotated toward the upstream side of the second conveyance path R2). Then, the preceding stack of recording sheets start to be discharged, and also, the first recording sheet P1 of the subsequent group and the second recording sheet P2 of the subsequent group start to be conveyed in two layers.

Figure 11:
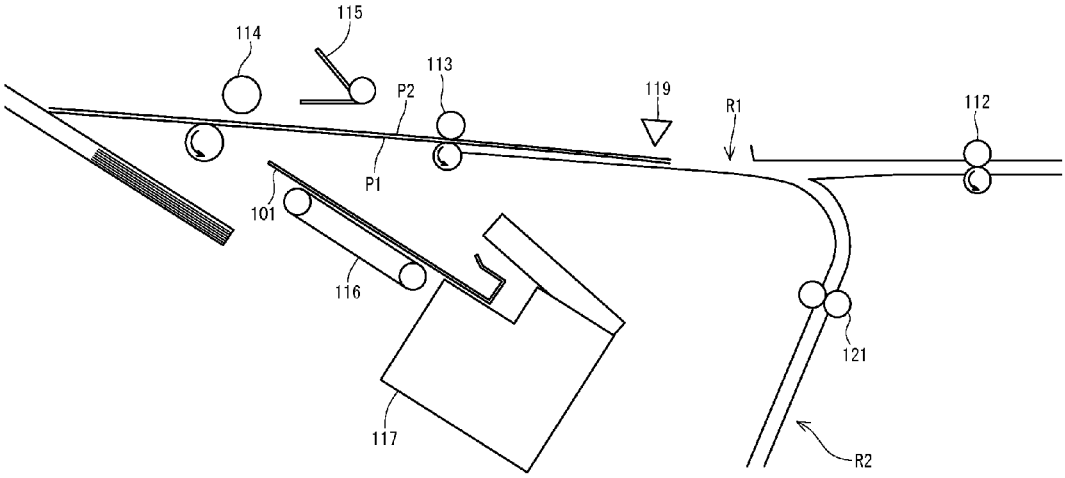
FIG. 11 is a diagram illustrating a post-processing step of the post-processor.

Then, the preceding stack of recording sheets are discharged to the main tray 90 by the main tray discharge rollers 114. The first recording sheet P1 of the subsequent group and the second recording sheet P2 of the subsequent group on top of the other are conveyed by the accommodation rollers 113, the main tray discharge rollers 114, the intermediate rollers 112, and the switch-back rollers 121. When the trailing edge of the preceding stack of recording sheets passes the main tray discharge rollers 114, as shown in FIG. 11, the main tray discharge rollers 114 are separated from each other. After the main tray discharge rollers 114 are separated from each other, the first recording sheet P1 of the subsequent group and the second recording sheet P2 of the subsequent group are conveyed by the accommodation rollers 113.

Figure 12:
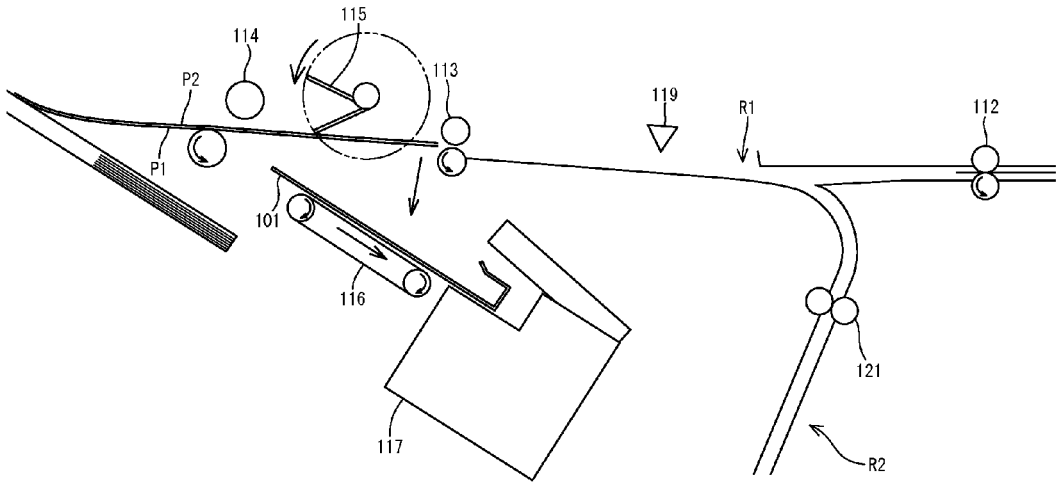
FIG. 12 is a diagram illustrating a post-processing step of the post-processor.

After the trailing edges of the first recording sheet P1 of the subsequent group and the second recording sheet P2 of the subsequent group pass the accommodation rollers 113, as shown in FIG. 12, the accommodation paddle 115 is rotated a predetermined number of times to accommodate the first recording sheet P1 of the subsequent group and the second recording sheet P2 of the subsequent group in the stack tray 101. Then, as described above, the longitudinal and widthwise alignment of the stack of recording sheets is performed.

According to this embodiment, the recording sheet sheafing discharge and the superposition conveyance of the recording sheets P are executed in the above-described manner. In this embodiment, the first recording sheet P1 of the subsequent group and the second recording sheet P2 of the subsequent group are conveyed at the same conveyance interval as the normal conveyance without increasing the conveyance interval of the recording sheets owing to the sheafing discharge. For this purpose, the first recording sheet P1 of the subsequent group is switched back and sidetracked to the second conveyance path R2. It should be noted that the intermediate rollers 112, the accommodation rollers 113, the main tray discharge rollers 114, and the switch-back rollers 121 are rotated at the same circumferential speed. As a method for detecting the sidetrack end position of the recording sheet P and the superposition conveyance position, a timer to measure time may be provided for calculating the position of the recording sheet P. Sensors other than the above-described sensors may be provided for the detection.

Figure 14:
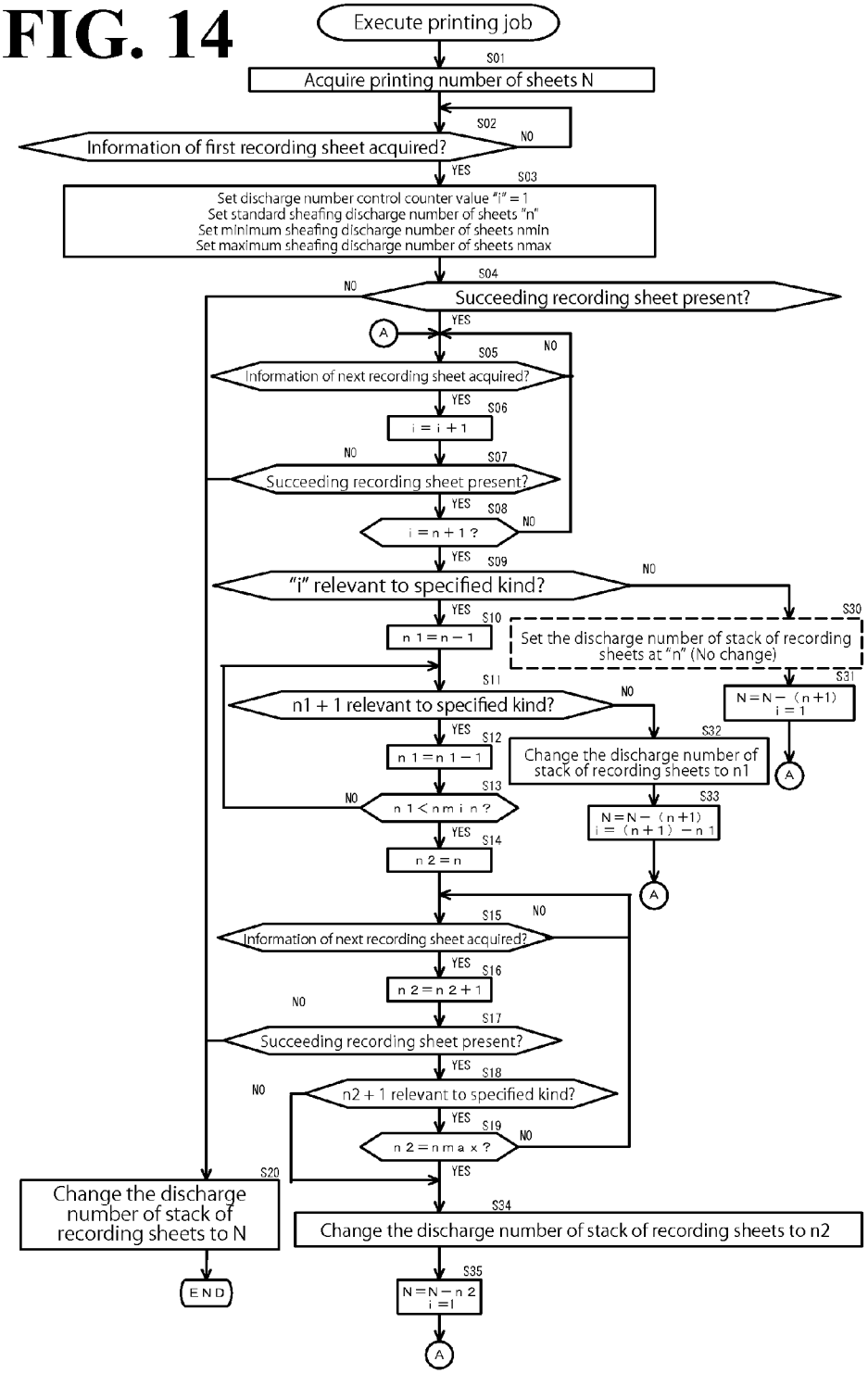
FIG. 14 is a flowchart illustrating an exemplary operation of the post-processor.

(4) Control of the Number of Stack of Recording Sheets at Recording Sheet Sheafing Discharge Next, referring to FIGS. 13 and 14, control of the number of a stack of recording sheets at the time of recording sheet sheafing discharge will be described.

First, the post-processor 2 acquires the total printing number of sheets N of a printing job from the image forming apparatus 3. Also, the post-processor 2 acquires recording sheet information of each printed recording sheet P and sets the standard sheafing number of sheets "n", the minimum discharge number of sheets $n_{min}$ at sheafing discharge, and the maximum discharge number of sheets $n_{max}$ at sheafing discharge. It should be noted that, at initial setting, the post-processor 2 sets the standard sheafing number of sheets "n" as the sheafing discharge number of recording sheets "n", and controls the standard sheafing number of sheets "n"

between the minimum discharge number of sheets $n_{min}$ and the maximum discharge number of sheets $n_{max}$.

The post-processor 2 acquires recording sheet information of an (n+1)th sheet, that is, a first recording sheet P1 of a subsequent group after sheafing and discharging recording sheets of the standard sheafing number "n". Then, the post-processor 2 determines whether the (n+1)th sheet P is relevant to a specified kind. A recording sheet P of the specified kind means a thick sheet having a basis weight equal to or more than a predetermined weight, a sheet folded by the above-described Z-folding rollers 104, or a sheet having a surface subjected to particular processing. For example, when the (n+1)th recording sheet P is irrelevant to the specified kind, as shown in FIG. 13A, the number of a stack of recording sheets to sheaf and discharge is kept at the standard sheafing number of sheets "n". Then, the (n+1)th recording sheet P is regarded as a first recording sheet P1 of a subsequent group, and this first recording sheet P1 of the subsequent group and an (n+2)th recording sheet P are superposed and conveyed to the stack tray 101.

When the (n+1)th recording sheet P is relevant to the specified kind, the post-processor 2 determines whether a recording sheet irrelevant to the specified kind is found among recording sheets P between an ($n_{min}$+1)th recording sheet and an n-th recording sheet. Recording sheet information of the recording sheets P between the ($n_{min}$+1)th recording sheet and the n-th recording sheet has already been acquired. If an n1-th recording sheet P irrelevant to the specified kind is found among the recording sheets P between the ($n_{min}$+1)th recording sheet and the n-th recording sheet, as shown in FIG. 13B, the number of the stack of recording sheets to sheaf and discharge is assumed to be n1, and the (n1+1)th recording sheet P is regarded as the first recording sheet P1 of the subsequent group. This first recording sheet P1 of the subsequent group and the (n1+2)th recording sheet P are superposed and conveyed to the stack tray 101.

If a recording sheet P irrelevant to the specified kind does not exist among the recording sheets P from the ($n_{min}$+1)th recording sheet to the n-th recording sheet, the post-processor 2 determines whether a recording sheet P among the recording sheets P from the (n+2)th recording sheet to the ($n_{max}$+1)th (n2-th) recording sheet is relevant to the specified kind each time the post-processor 2 acquires recording sheet information of the recording sheet P. For example, as shown in FIG. 13C, when the ($n_{max}$+1)th (n2-th) recording sheet is irrelevant to the specified kind, the number of the stack of recording sheets to sheaf and discharge is assumed to be n2, and the (n2+1)th recording sheet P is regarded as the first recording sheet P1 of the subsequent group. Then, this first recording sheet P1 of the subsequent group and the (n2+2)th recording sheet P are superposed and conveyed to the stack tray 101.

When a recording sheet P irrelevant to the specified kind does not exist among the recording sheets P from the (n+2)th recording sheet to the ($n_{max}$+1)th recording sheet, as shown in FIG. 13D, the number of the stack of recording sheets to sheaf and discharge is assumed to be $n_{max}$. Then, the ($n_{max}$+1)th recording sheet P and the ($n_{max}$+2)th recording sheet P are not superposed but conveyed to the stack tray 101 one by one. In this case, the ($n_{max}$+1)th recording sheet P is not switched back but conveyed to next processing without waiting for the ($n_{max}$+2)th recording sheet P to be conveyed. The next processing in this embodiment is conveyance to the stack tray 101. Consequently, the ($n_{max}$+1)th recording sheet P is conveyed to and accommodated in the stack tray 101. A timing of conveyance of the ($n_{max}$+1)th recording sheet P is controlled to have such an interval that the ($n_{max}$+1)th recording sheet P is not conveyed to and accommodated in the stack tray 101 while the preceding stack of recording sheets are being sheafed and discharged.

Next, referring to FIG. 14, description will be made on a flow of determining the discharge number of a stack of recording sheets to execute the above-described control of the discharge number of the stack of recording sheets. In the control of the number of the stack of recording sheets at the time of sheafing discharge, the post-processor 2 first acquires the number of all printing sheets N of a printing job transmitted from the image forming apparatus 3 (S01). Recording sheet information corresponding to each of the recording sheets P of the number N is transmitted from the image forming apparatus 3 to the post-processor 2. First, the post-processor 2 acquires recording sheet information of a first recording sheet P of the printing job (S02). The post-processor 2 does not proceed to the next step until the post-processor 2 acquires the recording sheet information of the first recording sheet P of the printing job at step S02. The post-processor 2 proceeds to the next step after at least acquiring the recording sheet information of the first recording sheet P of the printing job.

Then, the post-processor 2 initializes a discharge number control counter value "i" (sets it to 1). Also, the post-processor 2 sets the standard sheafing number of sheets "n", the minimum discharge number of sheets $n_{min}$ at sheafing discharge, and the maximum discharge number of sheets $n_{max}$ at sheafing discharge based on the above-described recording sheet information (S03). Next, comparing the discharge number control counter value "i" with the printing number of sheets N, the post-processor 2 determines whether a recording sheet P succeeding the first recording sheet P exists (S04). When no recording sheet P succeeds the first recording sheet P, the post-processor 2 changes the discharge number of the stack of recording sheets to N (S20) and ends the operation.

When a recording sheet P succeeding the first recording sheet P exists, the post-processor 2 acquires the next recording sheet information (S05). Then, the post-processor 2 adds 1 to the discharge number control counter value "i" (S06) and updates the discharge number control counter value "i". The post-processor 2 determines whether a further succeeding recording sheet P exists (S07). Then, the post-processor 2 compares the sum of the standard sheafing number of sheets "n" and 1 with the discharge number control counter value "i" (S08). Until the discharge number control counter value "i" becomes n+1, the post-processing 2 repeats steps S05 to S08. That is, the post-processor 2 acquires and stores the recording sheet information of the respective recording sheets P up to the (n+1)th recording sheet (first recording sheet succeeding the n-th recording sheet).

After acquiring recording sheet information of the (n+1)th recording sheet, the post-processor 2 determines whether the (n+1)th recording sheet P is relevant to the specified kind based on the recording sheet information of the (n+1)th recording sheet (S09). It should be noted that the (n+1)th recording sheet P becomes a first recording sheet P1 of a subsequent group when sheafing discharge is executed by the standard sheafing number of sheets "n".

When the (n+1)th recording sheet P is irrelevant to the specified kind, the post-processor 2 sets the discharge number of the stack of recording sheets to sheaf and discharge at "n" (does not change from the initial setting) (S30). The post-processor 2 updates the printing number N to the initial printing number N from which n+1 is subtracted, that is, to the number of the rest of the recording sheets after sheafing discharge. Also, the post-processor 2 initializes the discharge number control counter value "i" (S31). Then, returning to step S05, the post-processor 2 repeats steps S05 to S08 until the discharge number control counter value "i" reaches n+1.

When it is determined that the (n+1)th recording sheet P is relevant to the specified kind at step S09, the post-processor 2 makes the discharge number of the stack of recording sheets "n" smaller than the standard sheafing number of sheets "n". The post-processor 2 determines whether there exists a case in which the first recording sheet P1 of the subsequent group after sheafing discharge of recording sheets between the standard sheafing number of sheets "n" and the minimum discharge number of sheets $n_{min}$ is irrelevant to the specified kind. Specifically, the post-processor 2 sets the standard sheafing number of sheets "n" from which 1 is subtracted, that is, n−1, as n1 anew (S10). The post-processor 2 determines whether the (n1+1)th recording sheet P is relevant to the specified kind (S11).

When the (n1+1)th recording sheet P is irrelevant to the specified kind, the post-processor 2 changes the discharge number of the stack of recording sheets to sheaf and discharge "n" to n1 (S32). The post-processor 2 changes the printing number N to the initial printing number N from which n+1 is subtracted, and also, the post-processor 2 updates the discharge number control counter value "i" to n+1 from which n1 is subtracted (S33). Then, the post-processor 2 returns to step S05.

When it is determined that the (n1+1)th recording sheet P is relevant to the specified kind at step S11, n1 is changed to n1−1 (S12). Then, n1 is compared with the minimum discharge number of sheets $n_{min}$ set at step S03 (S13) to determine whether n1 is smaller than the minimum discharge number of sheets $n_{min}$. When n1 is not smaller than the minimum discharge number of sheets $n_{min}$, the post-processor 2 returns to step S11. Based on n1 changed at step S12, the post-processor 2 determines whether the (n1+1)th recording sheet P is relevant to the specified kind. Steps S11 to S13 are repeated in this manner. When there is a case in which the (n1+1)th recording sheet P is irrelevant to the specified kind until n1 becomes smaller than the minimum discharge number of sheets $n_{min}$, the post-processor 2 proceeds to step S32.

Until n1 becomes smaller than the minimum discharge number of sheets $n_{min}$, a recording sheet irrelevant to the specified kind is not found. In this case, the post-processor 2 makes the discharge number of the stack of recording sheets "n" larger than the standard sheafing number of sheets "n" and determines whether there is a case in which a first recording sheet P1 of a subsequent group after discharging the stack of recording sheets between the standard sheafing number of sheets "n" and the maximum discharge number of sheets $n_{max}$ is irrelevant to the specified kind. Specifically, the post-processor 2 sets n2 equal to the standard sheafing number of sheets "n" anew (S14), and acquires recording sheet information of the (n2+1)th recording sheet, that is, a recording sheet next to the n2-th recording sheet (S15). Then, the post-processor 2 adds 1 to the set n2 (S16) to update n2, and determines whether a succeeding recording sheet P is present (S17). When a succeeding recording sheet P is present, the post-processor 2 determines whether the (n2+1)th recording sheet P is relevant to the specified kind (S18).

When the (n2+1)th recording sheet P is irrelevant to the specified kind, the discharge number of the stack of recording sheets to sheaf and discharge "n" is changed to n2 (S34). The post-processor 2 subtracts n2 from the initial printing number N and updates the printing number N to the difference. Also, the post-processor 2 initializes the discharge number control counter value "i" (S35). Then, the post-processor 2 returns to step S05.

When it is determined that the (n2+1)th recording sheet P is relevant to the specified kind at step S18, the post-processor 2 determines whether n2 is equal to the maximum discharge number of sheets $n_{max}$ (S19). When n2 is equal to the maximum discharge number of sheets $n_{max}$, the post-processor 2 proceeds to the above-described step S34. When n2 is smaller than the maximum discharge number of sheets $n_{max}$, the post-processor 2 returns to step S15 and repeats steps S15 to S19 until n2 reaches the maximum discharge number of sheets $n_{max}$.

With the configuration according to the first embodiment, the number of the stack of recording sheets is changed in such a manner that the first recording sheet P1 of the group subsequent to the stack of recording sheets to sheaf and discharge is not a recording sheet P of the specified kind. Consequently, when the first recording sheet P1 of the subsequent group and the second recording sheet P2 of the subsequent group are superposed, misalignment of folded portions, multiple folding, and damage to the recording sheets are prevented to stabilize alignment of the stack of recording sheets at discharge. Further, when the first recording sheet P1 of the subsequent group and the second recording sheet P2 of the subsequent group are superposed, the first recording sheet P1 of the subsequent group is switched back and sidetracked to the second conveyance path R2. It is therefore unnecessary to provide a conveyance path for exclusive use of conveying a recording sheet of the specified kind. This prevents enlargement of the apparatus and suppresses an increase in the number of component parts, thereby preventing the cost from rising.

The first recording sheet P1 of the subsequent group is sidetracked to the second conveyance path R2 diverging from the first conveyance path R1. The second recording sheet P2 of the subsequent group is conveyed on the first conveyance path R1, following the first recording sheet P1 of the subsequent group. The sidetracked first recording sheet P1 of the subsequent group and the second recording sheet P2 of the subsequent group are superposed and conveyed. Consequently, the first recording sheet P1 of the subsequent group and the second recording sheet P2 of the subsequent group are conveyed at the same interval as the normal conveyance. This prevents degradation of the productivity owing to sheafing discharge.

Even in the case of a printing job including a recording sheet P of the specified kind such as a folded recording sheet P, a recording sheet P having a basis weight equal to or more than a predetermined weight, and a recording sheet P having a surface subjected to particular processing, alignment of the stack of recording sheets at discharge is stabilized.

Since the first recording sheet P1 of the subsequent group is switched back and sidetracked to the second conveyance path R2 toward the saddle stitcher 120, sidetracking the first recording sheet P1 of the subsequent group is performed in the same manner as conveying a recording sheet P to the saddle stitcher 120. This allows the first recording sheet P1 of the subsequent group to be sidetracked only by the conveyance rollers and the conveyance path existing already. It is therefore unnecessary to individually provide a conveyance path and conveyance rollers for exclusive use of sidetracking. This prevents enlargement of the apparatus and suppresses an increase in the number of component parts, thereby preventing the cost from rising.

In sidetracking the first recording sheet P1 of the subsequent group, the sidetracking operation is stopped when the leading or trailing edge of the first recording sheet P1 of the subsequent group reaches the predetermined sidetrack end position. This minimizes the sidetracking operation. Therefore, it is unnecessary to increase the conveyance interval of the recording sheets P, and also, damage to the first recording sheet P1 of the subsequent group due to the sidetracking operation is suppressed to the minimum level.

The recording sheet conveyance interval is controlled to make the second recording sheet P2 of the subsequent group reach the superposition conveyance position after ending the sidetracking operation of the first recording sheet P1 of the subsequent group. After the first recording sheet P1 of the subsequent group is stopped, the second recording sheet P2 of the subsequent group is superposed on the first recording sheet P1 of the subsequent group. As compared with a state of the first recording sheet P1 and the second recording sheet P2 both moving, conveyance of the recording sheets P is stabilized. This prevents misalignment of folded portions, multiple folding, and damage to the recording sheets P that occur at discharge.

(5) Others.

The present invention should not be limited to the above-described embodiments but may be modified in various manners. For example, in superposition control of recording sheets P, the position of the recording sheet superposition unit is not restricted. The present invention is applicable to a configuration in which the recording sheet superposition unit is disposed on the horizontal conveyor 200 of the post-processor 2.

In the embodiment of the present invention, in the image forming system, the recording sheet superposition unit may include a first conveyance path, a second conveyance path, and a sidetracking member. A recording sheet may be conveyed on the first conveyance path. The second conveyance path may diverge from an intermediate portion of the first conveyance path. The sidetracking member may be configured to sidetrack the recording sheet from the first conveyance path to the second conveyance path. The recording sheet superposition unit may be configured to superpose a trailing edge of the preceding recording sheet in a sidetracking direction and a leading edge of the succeeding recording sheet in a conveyance direction at a predetermined position on the first conveyance path. The preceding recording sheet may be sidetracked from the first conveyance path by the sidetracking member. The succeeding recording sheet may be conveyed to follow the preceding recording sheet. The controller may be configured to, when the preceding recording sheet is a recording sheet of the specified kind, control the recording sheet superposition unit to convey the preceding recording sheet to a next step without superposing the preceding recording sheet and the succeeding recording sheet.

In the embodiment of the present invention, in the image forming system, the sidetracking member may be configured to switch back the preceding recording sheet to sidetrack the preceding recording sheet to the second conveyance path.

In the embodiment of the present invention, in the image forming system, the sidetracking member may be configured to, in sidetracking the preceding recording sheet, stop sidetracking when a leading edge or a trailing edge of the preceding recording sheet reaches a predetermined position.

In the embodiment of the present invention, in the image forming system, the controller may be configured to, when the preceding recording sheet and the succeeding recording sheet are superposed, control a recording sheet conveyance interval between the preceding recording sheet and the succeeding recording sheet to make a leading edge or a trailing edge of the succeeding recording sheet reach a predetermined position on the first conveyance path after stopping sidetracking the preceding recording sheet.

In the embodiment of the present invention, in the image forming system, the controller may be configured to, when the preceding recording sheet is not a recording sheet of the specified kind, control the recording sheet superposition unit to superpose the preceding recording sheet and the succeeding recording sheet irrespective of a recording sheet kind of the succeeding recording sheet.

In the embodiment of the present invention, in the image forming system, a number of the recording sheets superposed and conveyed may be two.

In the embodiment of the present invention, the image forming system may be a post-processor configured to superpose a plurality of recording sheets on top of another by a predetermined number of sheets and discharge the recording sheets. The preceding recording sheet may be a first recording sheet conveyed next to the discharged stack of recording sheets.

In the embodiment of the present invention, in the image forming system, the recording sheet of the specified kind may be a folded recording sheet.

In the embodiment of the present invention, in the image forming system, the recording sheet of the specified kind may be a recording sheet having a basis weight equal to or more than a predetermined weight.

In the embodiment of the present invention, in the image forming system, the recording sheet of the specified kind may be a recording sheet having a surface subjected to particular processing.

According to the embodiment of the present invention, the controller controls the recording sheet superposition unit not to superpose the preceding recording sheet and the succeeding recording sheet when the controller refers to recording sheet information of the preceding recording sheet and determines that the preceding recording sheet is a recording sheet of the specified kind. Consequently, the recording sheets of a non-specified kind are superposed and conveyed, which improves productivity, and also stabilizes the superposition conveyance. Further, a conveyance path for exclusive use of conveying recording sheets of the specified kind is not required. This prevents enlargement of the apparatus and suppresses an increase in the number of the component parts, thus preventing the cost from rising.

Obviously, numerous modifications and variations of the present invention are possible in light of the above teachings. It is therefore to be understood that within the scope of the appended claims, the present invention may be practiced otherwise than as specifically described herein.

What is claimed:

1. An image forming system configured to superpose a plurality of recording sheets on top of another by a predetermined number of sheets and discharge the recording sheets, the image forming system comprising:

a recording sheet conveyor configured to convey the recording sheets;

a recording sheet superposition unit configured to superpose a preceding recording sheet and a succeeding recording sheet sent from the recording sheet conveyor; and a controller configured to control the recording sheet superposition unit not to superpose the preceding recording sheet and the succeeding recording sheet when the controller refers to recording sheet information of the preceding recording sheet and determines that the preceding recording sheet is a recording sheet of a specified kind;

wherein the recording sheet superposition unit comprises a first conveyance path on which a recording sheet is conveyed, a second conveyance path diverging from an intermediate portion of the first conveyance path, and a sidetracking member configured to sidetrack the recording sheet from the first conveyance path to the second conveyance path, wherein the recording sheet superposition unit is configured to superpose a trailing edge of the preceding recording sheet in a sidetracking direction and a leading edge of the succeeding recording sheet in a conveyance direction at a predetermined position on the first conveyance path, the preceding recording sheet being sidetracked from the first conveyance path by the sidetracking member, the succeeding recording sheet being conveyed to follow the preceding recording sheet, and wherein the controller is configured to, when the preceding recording sheet is a recording sheet of the specified kind, control the recording sheet superposition unit to convey the preceding recording sheet to a next step without superposing the preceding recording sheet and the succeeding recording sheet;

the controller is configured to control the recording sheet superposition unit in such a manner that:

referring to recording sheet information relating to the preceding recording sheet, the preceding recording sheet and the succeeding recording sheet are superposed by adjusting the number of recording sheets included in a stack of recording sheets so that the preceding recording sheet to be conveyed next to the stack of recording sheets to be discharged as a group does not become a recording sheet of a specified kind; and the preceding recording sheet and the succeeding recording sheet are conveyed one by one without superposing the preceding recording sheet and the succeeding recording sheet when the preceding recording sheet is specified as a recording sheet of the specified kind.

2. The image forming system according to claim 1, wherein the sidetracking member is configured to switch back the preceding recording sheet to sidetrack the preceding recording sheet to the second conveyance path.

3. The image forming system according to claim 1, wherein the sidetracking member is configured to, in sidetracking the preceding recording sheet, stop sidetracking when a leading edge or a trailing edge of the preceding recording sheet reaches a predetermined position.

4. The image forming system according to claim 1, wherein the controller is configured to, when the preceding recording sheet and the succeeding recording sheet are superposed, control a recording sheet conveyance interval between the preceding recording sheet and the succeeding recording sheet to make a leading edge or a trailing edge of the succeeding recording sheet reach a predetermined position on the first conveyance path after stopping sidetracking the preceding recording sheet.

5. The image forming system according to claim 1, comprising a post-processor configured to superpose a plurality of recording sheets on top of another by a predetermined number of sheets and discharge the recording sheets, wherein the preceding recording sheet is a first recording sheet conveyed next to the discharged stack of recording sheets.

* * * * *